US007533849B2

(12) United States Patent
Zemany et al.

(10) Patent No.: US 7,533,849 B2
(45) Date of Patent: May 19, 2009

(54) OPTICALLY GUIDED MUNITION

(75) Inventors: Paul D. Zemany, Amherst, NH (US); Mark A. Carlson, Amherst, NH (US); John A. Maynard, Amherst, NH (US)

(73) Assignee: BAE Systems Information And Electronic Systems Integration Inc., Nashua, NH (US)

( * ) Notice: Subject to any disclaimer, the term of this patent is extended or adjusted under 35 U.S.C. 154(b) by 11 days.

(21) Appl. No.: 11/629,062

(22) PCT Filed: Feb. 7, 2006

(86) PCT No.: PCT/US2006/004189

§ 371 (c)(1),
(2), (4) Date: Dec. 8, 2006

(87) PCT Pub. No.: WO2006/088687

PCT Pub. Date: Aug. 24, 2006

(65) Prior Publication Data

US 2007/0205320 A1 Sep. 6, 2007

Related U.S. Application Data

(60) Provisional application No. 60/650,719, filed on Feb. 7, 2005.

(51) Int. Cl.
*F41G 7/00* (2006.01)
*F42B 15/01* (2006.01)
*F42B 15/00* (2006.01)

(52) U.S. Cl. ..... 244/3.16; 244/3.1; 244/3.15; 244/3.21; 244/3.24; 89/1.11; 89/1.35; 102/382; 102/473; 102/501

(58) Field of Classification Search ..... 244/3.1–3.3; 89/1.11, 1.35, 1.8; 102/374, 379, 382–397, 102/200, 206–220, 275.9, 473–529
See application file for complete search history.

(56) References Cited

U.S. PATENT DOCUMENTS

| | | | | |
|---|---|---|---|---|
| 2,730,715 | A | | 1/1956 | Guanella et al. |
| 3,111,088 | A | * | 11/1963 | Fisk ..... 244/3.23 |
| 3,145,949 | A | * | 8/1964 | Smith, Jr. ..... 244/3.16 |
| 3,154,266 | A | | 10/1964 | Sheppard et al. |
| 3,233,848 | A | * | 2/1966 | Byrne ..... 244/3.14 |
| 4,037,806 | A | * | 7/1977 | Hirsch et al. ..... 244/3.16 |
| 4,136,343 | A | | 1/1979 | Heffner et al. |
| 4,373,688 | A | * | 2/1983 | Topliffe ..... 244/3.24 |
| 4,383,663 | A | | 5/1983 | Nichols |

(Continued)

OTHER PUBLICATIONS

"fuse." Encyclopedia Britannica. 2008. Encyclopedia Britannica Online. Feb. 16, 2008. britannica.com/eb/article-9035710.*

*Primary Examiner*—Bernarr E Gregory
(74) *Attorney, Agent, or Firm*—Michael Sand; Sand & Sebolt; Daniel J. Long

(57) ABSTRACT

An optically guided mortar comprising a three axis canard assembly, an optical seeker, a guidance and control processor, and a fuze mechanism. The optical seeker is a direct replacement for existing standard mortar fuzes. The resulting system significantly improves current mortar circular error probability (CEP) and results in overall reduction of cost of target prosecution, reduction in collateral damage, improved crew survivability, and adds compatibility against limited non-stationary targets. The optical seeker detects an optical illuminator located at a target and supplies signals to the guidance and control processor which through a guidance algorithm supplies steering commands to drive motors of the three axis canard assembly which move a plurality of guidance canards to accurately direct the munition toward a target.

20 Claims, 7 Drawing Sheets

U.S. PATENT DOCUMENTS 4,408,734 A 10/1983 Koreicho
4,422,601 A 12/1983 Chavany et al.
4,438,893 A * 3/1984 Sands et al. ..... 244/3.21
4,512,537 A * 4/1985 Sebestyen et al. ..... 244/3.21
4,522,356 A 6/1985 Lair et al.
4,561,611 A * 12/1985 Sinclair et al. ..... 244/3.16
4,568,039 A * 2/1986 Smith et al. ..... 244/3.15
4,606,514 A 8/1986 Sundermeyer
4,711,412 A 12/1987 Wallermann
4,856,733 A 8/1989 Lachmann
4,883,239 A 11/1989 Lachmann et al.
5,064,140 A 11/1991 Pittman et al.
5,260,709 A 11/1993 Nowakowski
5,379,968 A * 1/1995 Grosso ..... 244/3.21
5,425,514 A * 6/1995 Grosso ..... 244/3.22
5,439,188 A * 8/1995 Depew et al. ..... 244/3.21
5,467,940 A 11/1995 Steuer
5,478,028 A 12/1995 Snyder
5,631,654 A 5/1997 Karr
5,647,558 A 7/1997 Linick
5,651,512 A 7/1997 Sand et al.
5,685,504 A * 11/1997 Schneider et al. ..... 244/3.11
6,138,944 A 10/2000 McCowan et al.
6,244,536 B1 6/2001 Cloutier
6,467,721 B1 10/2002 Kautzsch et al.
6,621,059 B1 9/2003 Harris et al.
6,869,044 B2 * 3/2005 Geswender et al. ..... 244/3.29
6,880,468 B2 * 4/2005 Hellman ..... 102/524
6,981,672 B2 * 1/2006 Clancy et al. ..... 244/3.24
7,105,790 B2 * 9/2006 Lamorlette ..... 244/3.2
7,163,176 B1 * 1/2007 Geswender et al. ..... 244/3.27
7,226,016 B2 * 6/2007 Johnsson et al. ..... 244/3.28
7,500,636 B2 * 3/2009 Bredy ..... 244/3.15
2003/0037665 A1 * 2/2003 Rupert et al. ..... 89/1.8
2004/0094661 A1 * 5/2004 Johnsson et al. ..... 244/3.27
2004/0149157 A1 * 8/2004 Hellman ..... 102/524
2004/0200375 A1 * 10/2004 Kautzsch et al. ..... 102/385
2005/0229806 A1 * 10/2005 Johnsson ..... 102/490

* cited by examiner

OPTICALLY GUIDED MUNITION

CROSS REFERENCE TO RELATED APPLICATION

This application claims rights under 35 USC 119(e) from U.S. application Ser. No. 60/650,719, filed Feb. 7, 2005; the contents of which are incorporated herein by reference.

BACKGROUND OF THE INVENTION

1. Field of the Invention

The present invention relates to armaments and more particularly to guided munitions. More particularly, the invention relates to a mortar shell having a low cost, effective guidance system incorporated therein to correct its ballistic guidance path to an illuminated target.

2. Background Information

Mortars are one of the most commonly employed weapons in a ground combat unit. The traditional role of mortars has been to provide close and continuous fire support for maneuvering forces. Military history has repeatedly demonstrated the effectiveness of mortars. Their rapid, high-angle, plunging fires are invaluable against dug-in enemy troops and targets in defilade, which are not vulnerable to attack by direct fires. One of the major disadvantages of mortars is their comparatively low accuracy, and as a result mortars are becoming less effective in today's precision combat environment. Equipping a mortar round with a precision guidance package will increase its accuracy, enabling the mortar to be a precision munition that will be significantly more effective in wartime situations. For maximum utility, the guidance package preferably should be an inexpensive retrofit to current munitions, with a cost in production that allows its use in all situations, either as a guided or unguided weapon.

Unguided munitions are subject to aim error and wind disturbances. These factors, along with other more subtle error sources, may cause the munition to miss the target completely or require many rounds to complete the fire mission due to the resulting large CEP (Circular Error Probability). Current approaches to guided weapons are expensive and are used on larger, long range weapons. The approach of the present invention results in significantly lower cost and smaller size. This allows use with small to medium caliber weapons and significantly improves CEP which also results in a significant reduction in the quantity of rounds required to complete the fire mission which in turn results in lower overall cost and improved crew survivability. In addition, another benefit to this approach is the virtual elimination of collateral damage due to errant rounds impacting non-targeted areas. Furthermore, complete integration of a seeker/guidance error can be used in a modification to the existing fuze in order to "safe" errant rounds which are failing to meet an established CEP ground rule which further controls unwanted collateral damage by preventing detonation of off target rounds.

Mortars are typically unguided or guided by an expensive G&C (Guidance and Control) system. The cost is high for current guided mortars and unguided mortars may have poor accuracy. Also, unguided mortars may result in unacceptable collateral damage, excess cost due to the large number of rounds required to blanket the target area, and may expose the mortar crew to counterbattery fire due to the large time required to drop the necessary shells to saturate the target.

Therefore, there is a need for a mortar shell having an accurate and cost effective means incorporated therein for guiding the mortar munitions toward a target. There is also a need for a mortar having a low cost guidance and control G&C approach which is compatible with a large class of munition rounds. Furthermore, a subsequent need exists for preventing detonation of errant munition rounds to minimize non-target specific damage and non-combatant loss of life.

BRIEF SUMMARY OF THE INVENTION

The present invention is a low cost optically guided munition that consists of a "smart fuze" that is composed of a three axis canard assembly, optical seeker and related detection and tracking processor, guidance and control processor and related guidance and control algorithms, and a fuze mechanism. The "smart fuze" is a replacement of the standard M734A1 and or M783 fuze assemblies commonly used today on certain mortar shells. The munition equipped with the "smart fuze" homes in on an optical tag or other types of target illuminators, such as those targets that are illuminated by a laser designator. The fuze design is a replacement for the current multi-option fuze and is compatible with many types of munitions including 60, 81, and 120 mm mortar rounds with only minor changes required to the canard frame to accommodate increased caliber. The new guided mortar approach of the present invention demonstrates a limited capability against moving targets, formally not capable of prosecution using current, non-guided, mortar rounds. This provides a significant benefit to the user, and significantly improves accuracy and resulting reduction in CEP against stationary targets. Also, integration of the seeker CEP can be utilized as an advanced cue to prevent detonation of off target rounds.

The guided munition of the present invention receives error signals which are derived from an optical seeker which are inputted to a processor, which through a guidance algorithm generates the necessary steering commands which are relayed to drive motor circuits which move guidance canards to direct the munition toward a target. This process continues until the munition descends to the target with the optical seeker continuously updating an error signal to change the canards to null the error. The present invention also utilizes a plurality of gyros, preferably utilizing MEMS technology, which sense gravity induced overturning movement and provides a down reference. Furthermore, the optical seeker senses the target and looks off bore sight and uses a non-uniform pixel array. The controller makes range connections by comparing a nominal bore sight angle to measured bore sight angle as a function of time.

The munition of the present invention includes a guidance control assembly comprising four canards, two of which are common to a single shaft with the other two being connected to independent shafts, with each of the shafts being controlled by a stepper motor which derives its control signals from the guidance processor. A Ram Air Turbine (RAT) air duct system provides signaling air to an alternator and switch plate assembly and to a safe/arm rotor assembly as the munition moves through the air for arming the missile.

Furthermore, in accordance with another feature of the invention, the central processor subsystem processes the optical seeker output and validates an authentication code received from the target illuminator against the code provided to the munition to ensure that the munition and target are compatible.

These features and advantages are obtained by the improved optically guided munition of the present invention the general nature of which may be stated as including an optical seeker for detecting an optical illuminator located at a target; a processor for generating steering commands based upon sight information received by the optical seeker; a canard assembly for changing the flight path of the munition from its ballistic flight path based upon the steering commands received from the processor; and a fuze mechanism for detonating the munition upon said munition reaching the target.

BRIEF DESCRIPTION OF THE SEVERAL VIEWS OF THE DRAWINGS

The present invention is further described with reference to the accompanying drawings wherein.

Similar numerals refer to similar parts throughout the drawings.

DETAILED DESCRIPTION OF THE INVENTION

Figure 1:
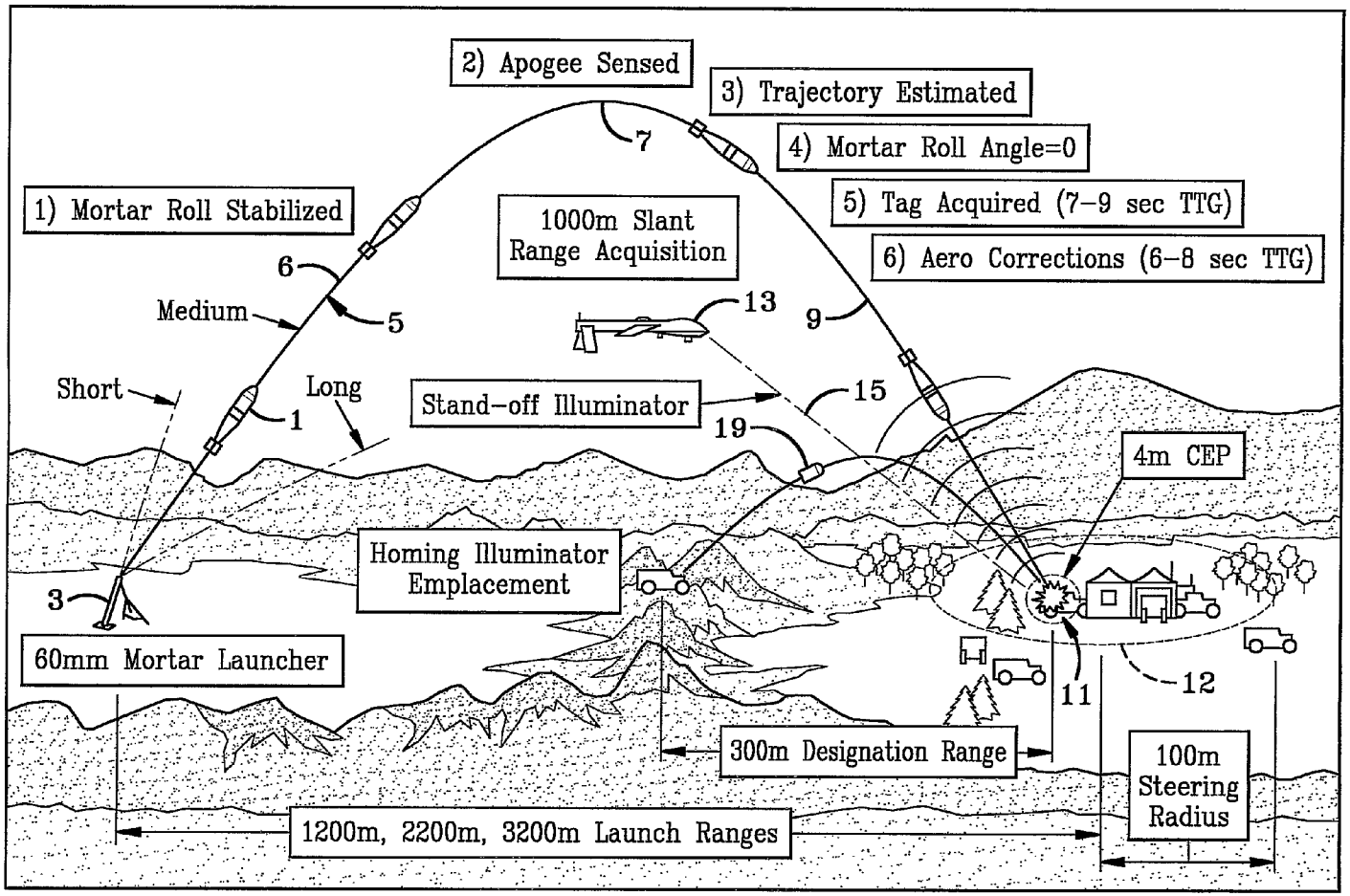
FIG. 1 is a perspective view showing the operation of a preferred embodiment of the optically guided munition of the present invention.
Figure 2:
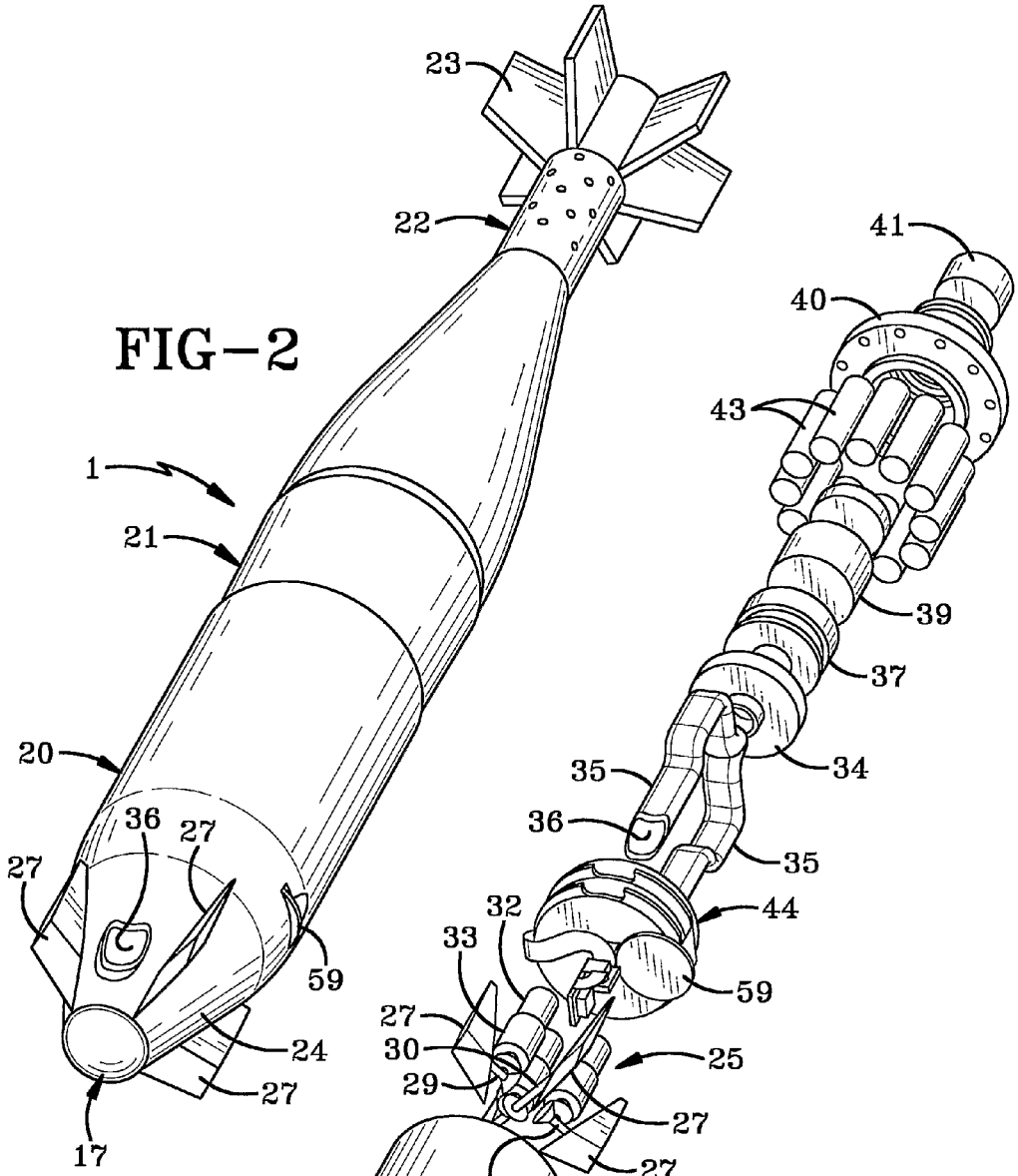
FIG. 2 is a perspective view of a preferred embodiment of the optically guided munition of the present invention.

In general, FIG. 1 is a diagrammatic depiction of the proposed Concept of Operations for the optically guided munition of the present invention. The mortar or optically guided munition with optical smart fuze, results in improved accuracy, (<4 m CEP) under standard operating conditions, a significant improvement over current operational capability.

The optically guided munition broadly consists of an optical seeker, rate gyros, processor, battery pack, and a 3-axis motor driven canard assembly as shown in FIGS. 2-6. All of the components are integrated, along with existing fuze components such as a safe/arm mechanism, booster pellet, RAT (Ram Air Turbine), impact and delay components, into a minimal fore body extension which replaces a current M734A1 fuze housing. The mortar functions by being launched in the general vicinity of the target and upon reaching apogee, begins the descent portion of the ballistic flight path wherein the optical seeker acquires the target (illuminated with an optical tag or laser designated by a stand off laser), and begins the guidance process to the target. Error signals which are derived through the optical seeker are inputted to a processor which, through a guidance algorithm, generates the necessary steering commands which are relayed to a motor drive circuit, which in turn, moves the requisite canards to effect steering. The process continues as the shell descends to the impact point with the seeker assembly continuously updating the error signal and canard deflections to null the error.

The smart fuze uses Micro-Electro-Mechanical Systems (MEMS) gyros to sense the gravity induced over turning moment to provide a down reference. The three axis canard assembly uses a differential deflection to control the roll angle and common deflections to develop an angle of attack to maneuver. An optical seeker array is used to sense the target and a guidance and control (G&C) algorithm uses the seeker information to compute the steering commands for the canards.

Figure 9:
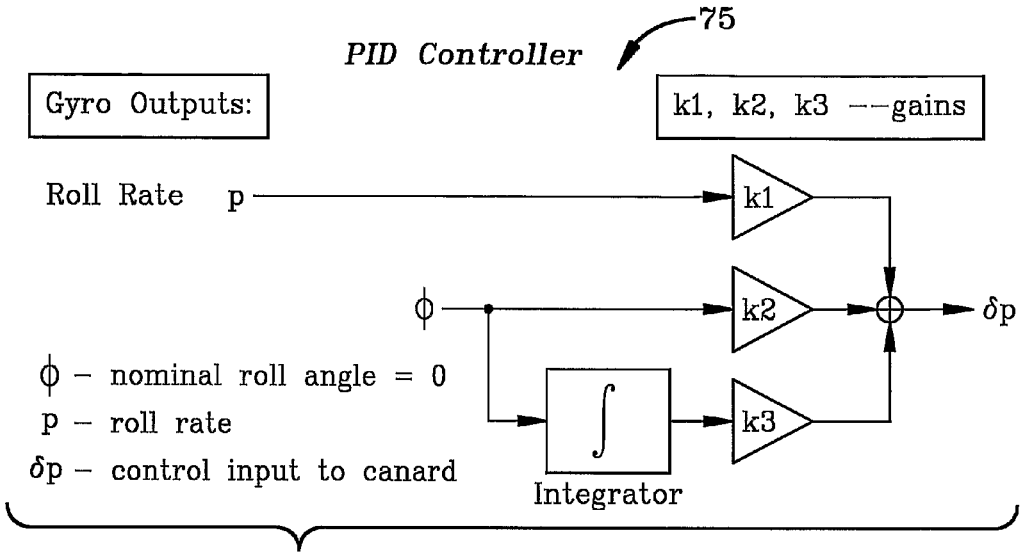
FIG. 9 is a schematic block diagram of a preferred embodiment of a Proportional-Integral-Derivative controller (PID) usable in the processor subsystem of the present invention.
Figure 10:
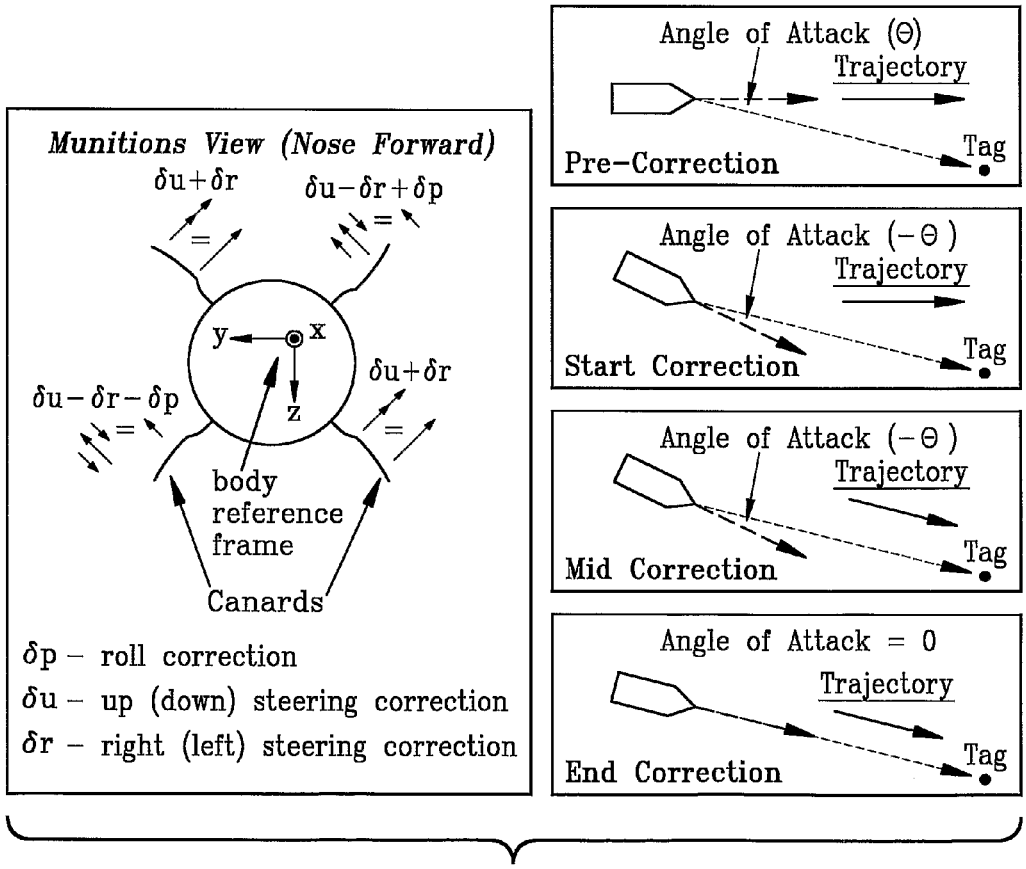
FIG. 10 is a schematic block diagram showing the seeker steering control for the munition of the present invention.

FIGS. 2-5 show the guided munition and the "smart fuze" assembly located in the forward or nose of the munition. FIGS. 6-9 diagrammatically illustrate the various electrical guidance and control components, with FIG. 10 illustrating the manner for correcting flight errors of the munition. The flight control assembly consists broadly of four canard aerodynamic control surfaces that are driven by three motors. One pair can be driven differentially for roll control as well as in a common mode for generation of normal acceleration required for maneuvering. The other pair is only driven in a common mode for generation of normal acceleration required for maneuvering.

To reduce costs, the optical seeker looks off bore sight. The roll angle of the round is controlled so that the seeker is facing the ground. At the start of the ballistic flight the target is off bore sight. It approaches bore sight as the round approaches the target. The controller (system processor) makes range corrections by comparing the nominal bore sight angle to the measured bore sight angle (as a function of time). Cross range corrections are made by keeping the heading centered. The system also contains a control processor assembly. This subsystem or control processor assembly generates the commands to control the three canard motors. It also estimates down and interfaces with the seeker.

Figure 6:
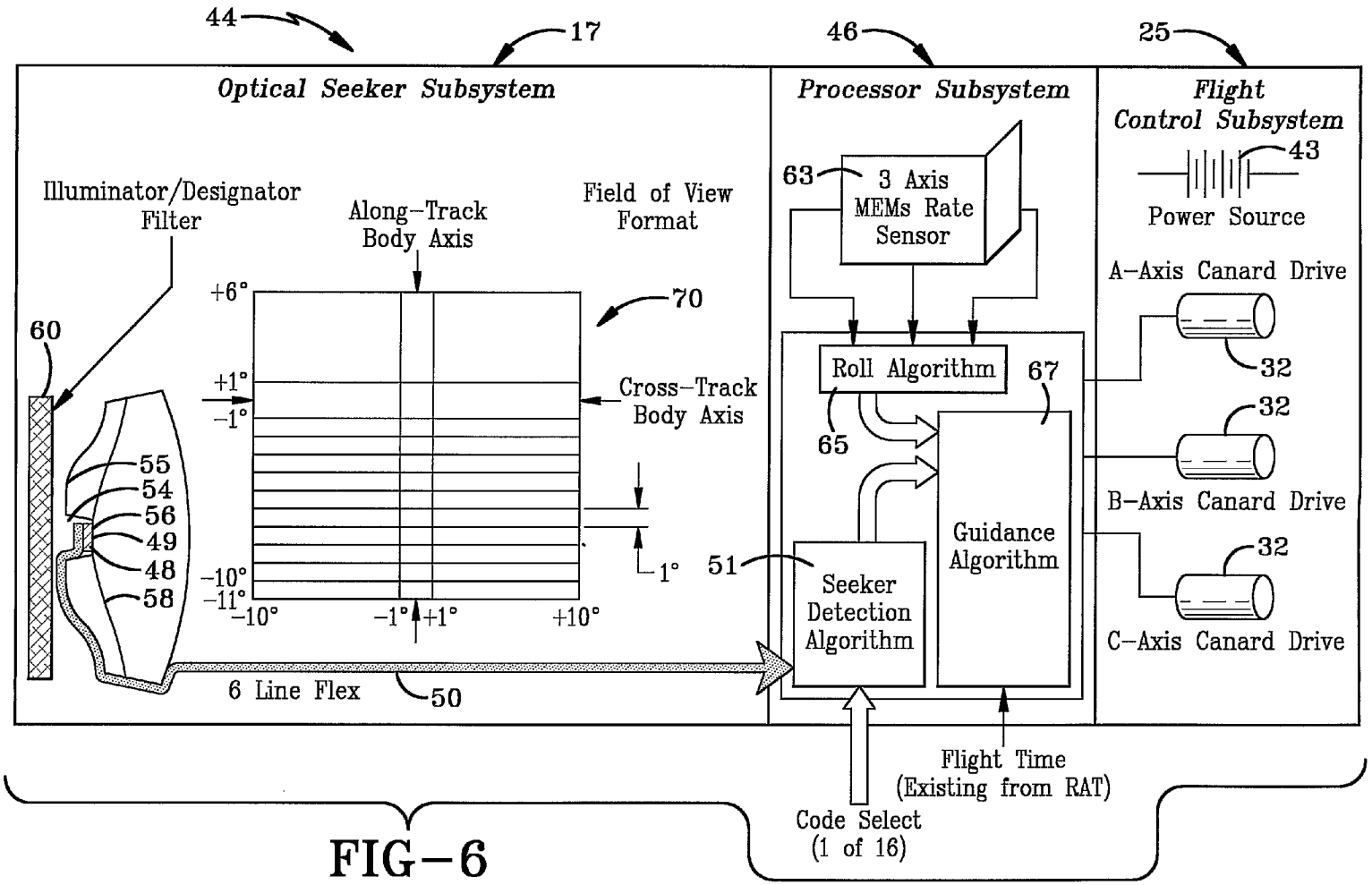
FIG. 6 is a system block diagram of the guidance and control system of the optically guided munition of the present invention.

FIG. 6 shows a block diagram of the overall control system. The optical seeker is optimized by using a non-uniform pixel array that provides sufficient data for steering. The projection roll angle is adjusted so that the detector array points towards the ground. This minimizes the required sensor field of view (FOV) and simplifies the optical design as well as resulting in the lowest cost embodiment. FIG. 6 also shows the control subsystem for the 3-axis canard actuator. Using the three motors, it is possible to control the projectile roll rate and angle and develop lateral maneuvers in two orthogonal directions. With this actuation method, maneuvers that account for down range error and cross range error can be generated.

The processor subsystem contains rate sensors (gyros) to provide data for roll angle estimation and down determination. A processor uses data from the gyros and seeker to generate roll control and steering commands to the 3-axis canard actuator. In addition, guidance integration of the fusing command can be performed which allows detonation of rounds which fall within a prescribed CEP and prevents detonation of errant rounds.

The apparatus of the present invention allows an existing munition to be equipped with a low cost "smart fuze", providing a significant improvement in targeting accuracy at a low cost. This also results in less exposure for the crew increasing their survivability, a significant reduction in collateral damage due to improved CEP, and a lower overall cost to prosecute a selected target.

The details of the optically guided munition of the present invention is as follows. The guided munition is indicated generally at 1, and is shown in FIG. 1 being discharged from a usual mortar launcher 3 which propels the munition into a normal ballistic path 5 which is determined by the angle of elevation of the mortar launcher, the weight of the munition, the size of the explosive propelling charge, atmospheric conditions such as wind, temperature, etc. Munition 1 follows generally its upward path 6 until it reaches apogee indicated at 7, where it starts its downward decent along a projected path 9 with the anticipation that it will hit a target 11 within an acceptable CEP, indicated by dashed lines 12.

In one embodiment, the target is illuminated by means of a stand off illuminator 13 which projects a beam 15 onto target 11. Beam 15 could be a laser or other type of optical detectable beam, which is detected by an optical seeker subsystem 17 (FIGS. 2-5) located in a forward portion or nose 20 of munition 1. The optical illuminator at target 11 can also be an optical tag 19 which is placed at the target by various means such as being propelled to the target from a grenade launcher, or various other types of delivery means. One type of optical tag is shown and described in detail in a pending patent application entitled, Radiation Homing Tag, U.S. Ser. No. 11/629,061, filed Feb. 7, 2006, the contents of which are incorporated herein by reference. The optical tag or other type of light source could always be placed secretly at the target prior to the launch of munition 1. The main feature of the illuminator regardless of its particular type and method of arriving at the target site, is that it will radiate an optical recognized signal to direct munition 1 to the target. The target illuminator preferably will operate at a frequency not visible by the human eye preventing it from being exposed to an enemy at the target site. Furthermore, the illuminator may be operated at a coded frequency which must be validated by munition 1 in order to arm the munition for explosion upon reaching the target.

Figure 3:
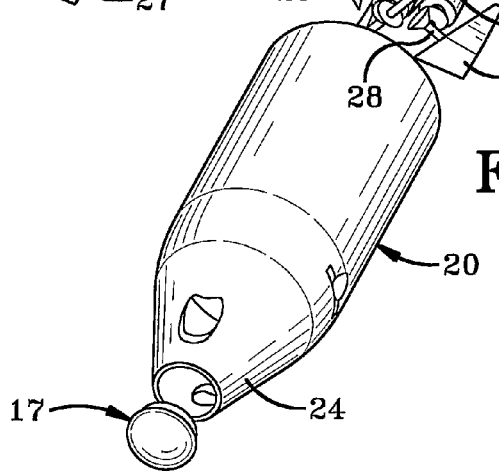
FIG. 3 is an exploded perspective view of the optical smart fuze portion of the optically guided munition of FIG. 2.

Munition 1 in the preferred embodiment is a modified mortar shell or round which consists of a usual outer shell casing or body 21 having a hollow interior 18 for containing the explosive charge (FIGS. 2-5). A tail fin 23 provides aerodynamic stability to the mortar round during its ballistic flight and a usual propulsion charge for initially propelling the munition into its ballistic flight pattern is located in a body section 22 just forward of fin 23. Nose 20, which provides the housing for the smart fuze of the invention, is a fore body extension and is mounted on a usual munition shell casing 21. In addition to mounting optical seeker 17 at the front end of nose 20, it contains a three axis aerodynamic guidance control assembly or subsystem indicated generally at 25 (FIG. 3).

Assembly 25 consists broadly of four canards 27, two of which are mounted each on an independent shaft 28 and 29, with another pair of canards being mounted on a single common shaft 30. The shafts are controlled by three drive motors, each indicated at 32. Each of the drive motors preferably is a high torque two phase stepper motor operatively connected to the canard shaft by a gear assembly 33. The term "canards" as used throughout also includes mid-body mounted wings or other aerodynamic control surfaces which can be used in the concept of the present invention.

In one embodiment, the stepper motors have an 18° step and the gear assembly is a 30/1 zero backlash spur gear arrangement. In another embodiment, the gear assembly includes a gear train consisting of a planetary gear, worm gear and pitch gear. Further details of a preferred embodiment of a three axis control assembly 25 is shown and described in a related patent application entitled, Three Axis Aerodynamic Control Of Guided Munitions, U.S. Ser. No. 11/629,921, filed Feb. 7, 2006, the contents of which are incorporated herein by reference.

Figure 5:
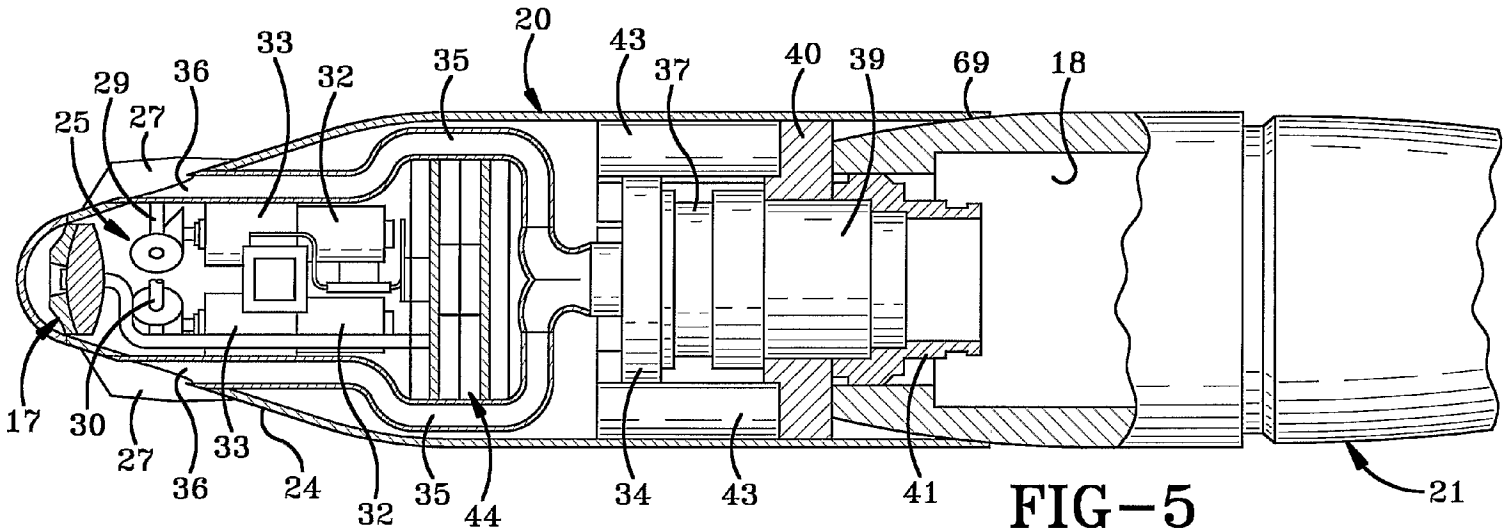
FIG. 5 is a fragmentary diagrammatic view with portions broken away and in section, of the optical smart fuze portion of the optically guided munition.

Also located in nose 20 will be a Ram Air Turbine (RAT) 34 including air ducts 35 which supply air through end openings 36 located in a tapered portion 24 of nose 20 for controlling an alternator and switch plate assembly 37, and a safe/arm rotor assembly 39. An end cap 40 is provided for securing the components shown particularly in FIG. 3, in nose 20, which forms the smart fuze of the invention. A booster pellet 41 preferably is located at the end of end plate 40 and is located within the end of outer shell casing 21 as shown in FIG. 5. An array of batteries 43 is mounted forwardly of end plate 40 for supplying the required power for the canard control motors and for a processor subsystem and an optical seeker subsystem discussed below. The particular arrangements of these components and their mounting within nose 20 as shown in FIGS. 3 and 5 can vary from that shown and described above without departing from the concept of the invention.

Referring particularly to FIG. 6, munition 1 and in particular the smart fuze portion thereof contains a guidance and control system indicated generally at 44 which includes optical seeker subsystem 17, a processor subsystem indicated generally at 46, and the three axis guidance control subsystem 25, shown diagrammatically therein. As munition 1 starts its downward descent on path 9, the optical seeker subsystem 17 acquires the target by detecting the illumination coming from the target generated by the stand off laser, optical tag 19 or other type of radiation. Optical seeker subsystem 17 preferably is broken into two components, the seeker optics 48 and detector array 49, shown diagrammatically and in further detail in FIG. 8. Because of the extremely close coupling between the seeker optics and the detector array, these two components preferably are assembled as an integral subassembly 17. Optical seeker subassembly 17 is tied into processor subsystem 46 as shown by arrow line 50, and provides input data to a seeker detection algorithm 51 which is part of the processor subsystem 46. A field of view (FOV) format provided in the optical seeker subsystem is key to the proper target recognition tracking and steering commands generated as a result of the work performed in the detection and tracking of the algorithm 51. Detector array 49 which preferably consists of a plurality of photodetectors, is centered on the optical axis, and a central hole 54 in a first lens element 55 provides the necessary clearance for the detector array 49 to be bonded to a central flat area 56 on a second lens element 58 (FIG. 6). Further details and manner of operation of one type of optical seeker subsystem which can be used in the present invention is shown and described in detail in a related pending patent application entitled, Optically Guided Munition Control System And Method, U.S. Ser. No. 11/632,671, filed Jan. 17, 2007, the contents of which are incorporated herein by reference.

The control processor subsystem 46 performs three primary functions in the improved guided munition 1. The first is the detection processing of the optical seeker output to validate the correct one of a number of authentication codes from the optical designator or target illuminator, and provide validated seeker outputs for navigation of the munition by control subsystem 25. The second function is to establish roll control of munition 1 by three axis gyros 63 which sense gravity induced over turning moment and provides a down reference. Gyros 63 communicate with a roll algorithm 65, which in turn provides input to a guidance algorithm 67, and thirdly provide steering commands to the flight control subsystem 25, and in particular to canard drive motors 32 based upon roll control and seeker outputs for moving the canards to home in the munition onto target 11. In addition to inputs from the optical seeker, processor subsystem 46 can receive inputs from the Ram Air Turbine (RAT) as to the time of flight and apogee determination, a G-switch launch detector for accurate launch determination, and the input from a thumb wheel switch 59 for authentication code selection, and finally an integral switch (not shown) with a disposable filter 60 for selection of laser designator versus illuminator. The apogee detect can also be supplied to the processor subsystem through external data other than the RAT of the fuze thereby eliminating any specific hardware dependency. The details regarding the guidance algorithm 67 are shown and described in further detail in a related pending patent application entitled, Ballistic Guidance Control For Munitions, U.S. Ser. No. 11/629,060, filed Feb. 7, 2006, the contents of which are incorporated herein by reference.

In summary, the photodetectors of optical seeker subassembly 17 senses the radiation source at the target, and in particular the signal provided by the optical designator or illuminator. This information is fed to the processor subsystem 46, which computes and supplies the required steering signals to the canard drive motors 32 of the control subsystem 25, which maneuver the plurality of canards 27 in the appropriate manner to enable munition 1 to follow the necessary glide path to target 11 where it will hit within a preferred CEP. If desired, in the event that the processor subsystem detects that the appropriate CEP will not occur, the safe/arm rotor assembly 39 will prevent the explosive charge within munition 1 from exploding, thus avoiding unwanted damage to property and personnel. Likewise, if the code-of-the-day (COD) secured from the target illuminator is not validated with the COD set in munition 1 by a thumb wheel switch 59 the munition will not arm.

In accordance with another feature of the invention, the guidance and control system 44 and various components discussed above and shown particularly in FIG. 3, are all fitted within the nose 20 which will include the usual fuze components located adjacent booster pellet 41 to cause detonations upon contact, at a certain elevation above the target, with a time delay or other settings well known in the fuze art. Nose 20, which houses all of the components of the smart fuze, is mounted usually by a threaded connection 69, onto outer shell casing body 21 (FIG. 5) replacing the heretofore threadedly attached standard fuze without the guidance and control system discussed above. This results in a slightly longer munition, but one having the same diameter as the previously replaced fuze, enabling it to be launched easily from a usual mortar launcher 3. This provides for a low cost modification to existing munitions. Furthermore, the components of the guidance and control systems are rugged miniature components with the optical seeker subsystem 17 and processor subsystem 46 being formed of printed circuit board components which can be compacted and protected in a rugged manner thereby adding minimal weight to the nose of the munition, yet which provides for the guidance and control of the munition upon approaching a target. Guidance and control system 44 can be implemented on double sided rigid-flex printed circuit boards which are placed in a stacked relationship and have a diameter compatible with the inner diameter of fuze 20 with components mounted normal to the direction of launch to further improve tolerance to launch shock loads as shown in FIG. 3.

Figure 8:
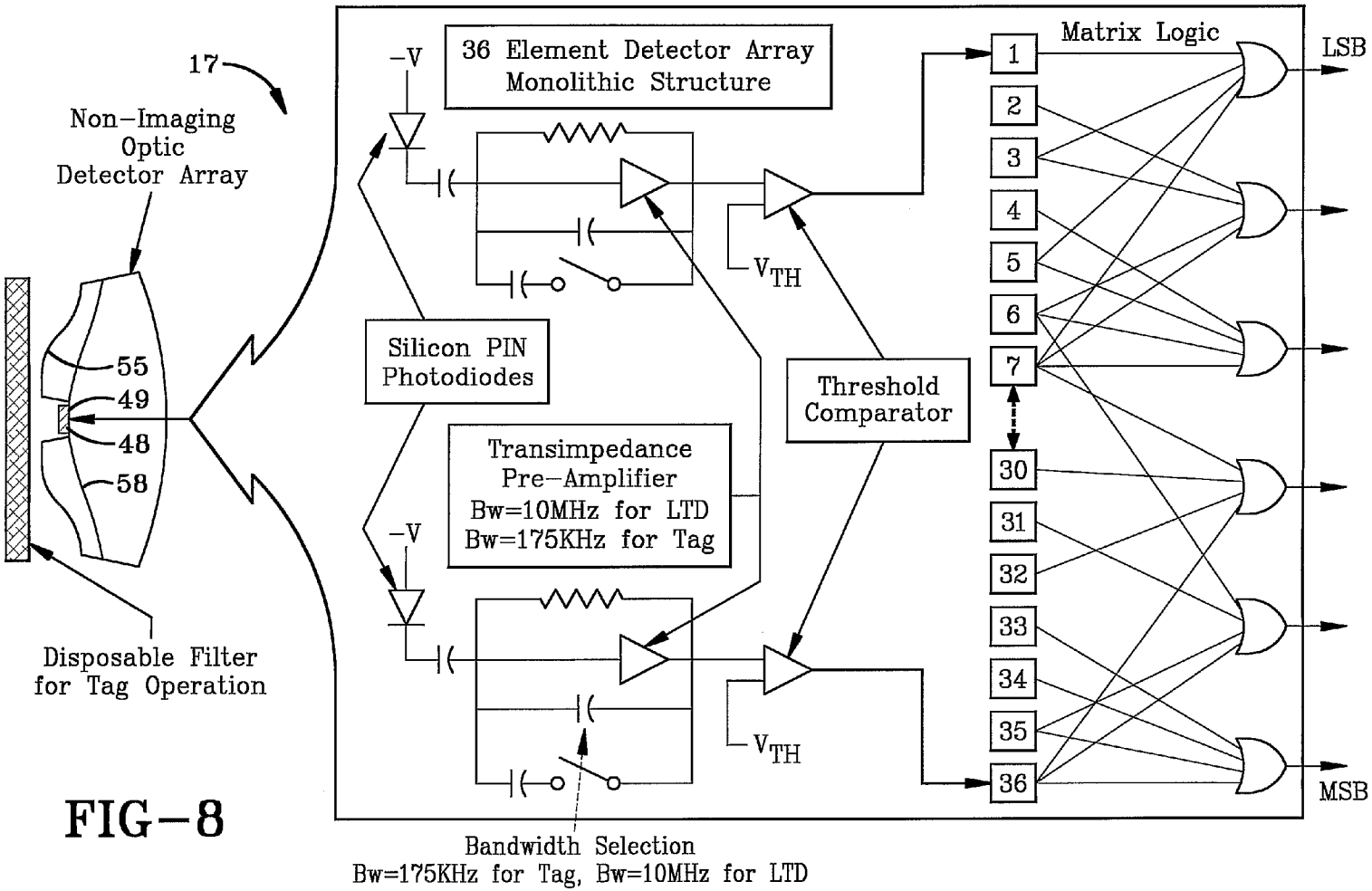
FIG. 8 is a schematic diagram of one type of optical seeker subassembly which can be used in the present invention.

Attached FIG. 8 is a more detailed block diagram of the optical seeker subassembly 17 of the present invention. FIG. 9 is a block diagram of the Proportional-Integral-Derivative controller (PID) feature of the processor subsystem 46 with FIG. 10 being a schematic block diagram showing the seeker steering control, the details of which are described in detail in the two related pending patent applications previously identified as Optically Guided Munition Control System And Method and Ballistic Guidance Control For Munitions. Guidance and Control Inputs to Detection Processing and Tracking The approach taken for guidance of munition 1 is to combine both "brute force" navigation to the target where the mortar flies a straight line to the target and "ballistic correction" which requires small steering corrections. Key to the navigation approach is target detection and tracking. At the start of control, discrete optical sensor output provided to processor subsystem 46 is used to estimate "down" and adjust the nominal ballistic trajectory based upon detection of the target through processing of the optical seeker quantized data. Range adjustment is based on the bore sight look down angle temporal history, and cross range control is based on the left/right centering error, data for which is an output of the optical seeker subassembly. As the flight progresses, the bore sight look down angle approaches zero (FIG. 10). When the lookdown angle is small, then the direct homing approach is used. This approach is selected because it takes advantage of the features of both approaches. The detection processing subsystem 46, through analysis of the optical seeker output, controls the actual technique selection which is then acted upon through the guidance and control algorithm. Further details of one type of control algorithm which can be used is described in the previously referenced pending patent application entitled, Ballistic Guidance Control For Munitions.

The "ballistic correction" approach does not require a high g vertical steering offset. In contrast, the "brute force" approach needs a large command in the early portion of the controlled flight. This favors using a "ballistic correction" at the start of the flight. This approach also eases demands on the detection processing and tracking algorithm.

During the final portion of the controlled flight, the required steering offset is smaller and a "brute force" approach can be used. The advantage of the "brute force" approach is that it is insensitive to trajectory estimation error or down estimation, both factors ease the burden on the detection processing and tracking algorithms providing an intrinsic robustness.

The approach to aerodynamic control is to stabilize, preferably deroll the roll vector of the mortar round. As manufactured, a typical 60 mm round is free to roll. Since the existence of body roll is indeterminate initially upon launch tube exit, the roll vector itself cannot be relied on to provide any method of control. Any optical sensor would either have to be derolled or have an excessively large field of regard (FOR) to be able to acquire and track the target at the extreme acquisition ranges in any arbitrary attitude. Additionally, the processing to determine the "down" vector is greatly simplified with a stabilized roll component.

The approach of the present invention for guiding the munition toward a target is shown diagrammatically in FIG. 10, and derives the absolute maximum normal force in the direction of the target as quickly as practical by deliberately controlling, then rolling the mortar airframe first into an X orientation relative to the target, then deflecting all four canards to develop the normal acceleration in the direction of the target. This method brings to bear all four canard surfaces in terms of maneuver force. It also positions the optical seeker field of view (FOV) in an optimal location to facilitate target tracking and output to the detection processor and integration of the guidance algorithm.

Figure 7:
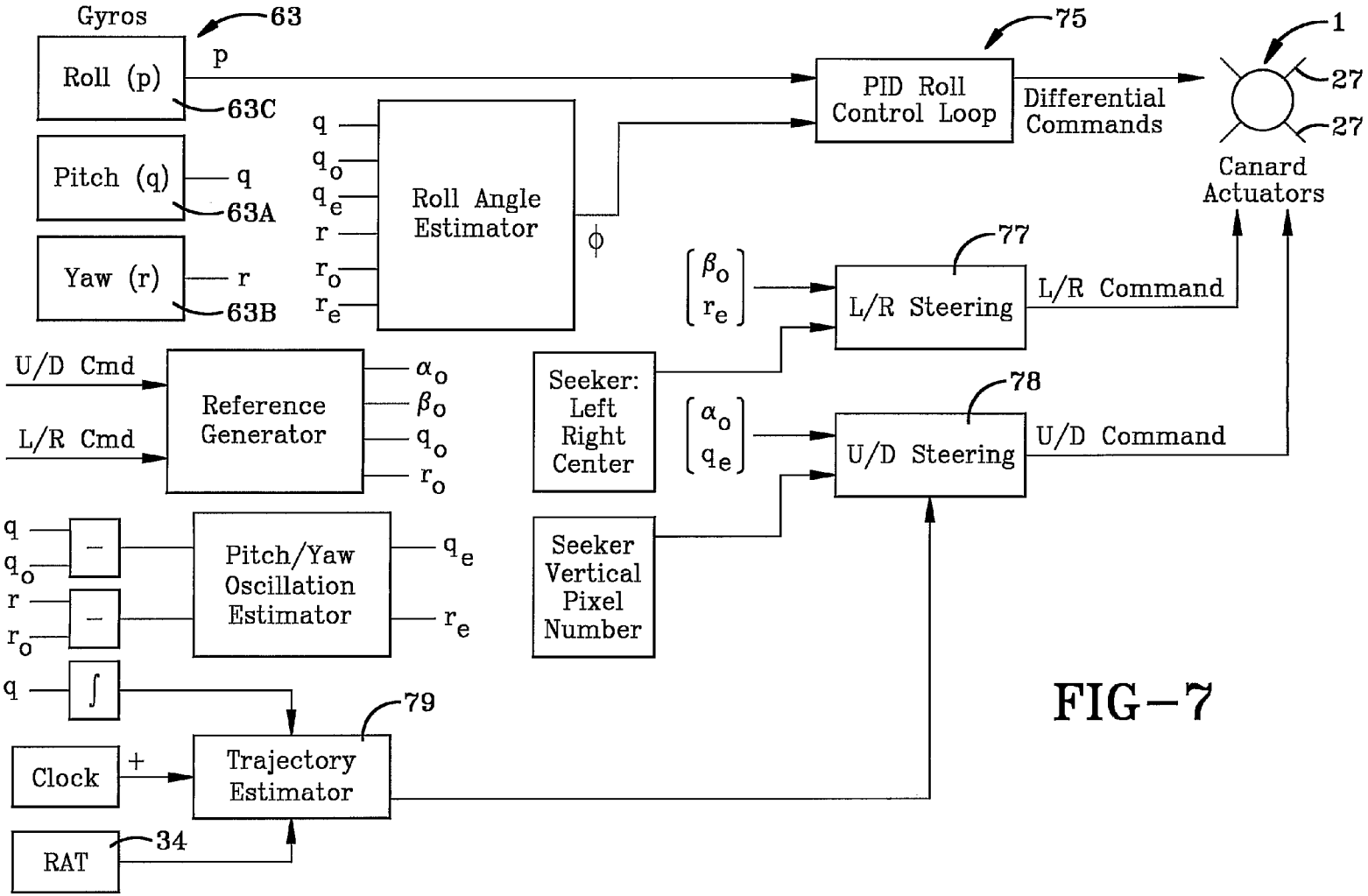
FIG. 7 is a block diagram showing further features of the guidance and control system for the optically guided munition of the present invention.

An initial set of key performance features for the optical seeker subsystem are shown in FIGS. 6-8. These are ultimately tied back to the detection processing and tracking algorithm as input data. Specifically, the field of view (FOV) format is key to proper target recognition, tracking, and the steering commands generated as a result of the work performed in the detection and tracking algorithm.

In a preferred embodiment, the seeker optics 48 has a 20-mm entrance-aperture diameter, with a field of regard (FOR) of ±10° cross-track and +6° to −11° along-track as shown by body axis graph 70 in FIG. 6. The physical size of the detector array 49 is approximately 2×2 mm. From these requirements it has been determined that the system's f-number must be on the order of 0.24. It is not theoretically possible to achieve this low f-number using a purely refractive system, due to the high curvatures required.

Since the detector array is centered on the optical axis, the entire optical system will be canted down 60 relative to the body axis, in order to provide the required FOR of −11° to +60 in the along-track direction. Central hole 54 in lens element 55 provides the necessary clearance for detector array 49 to be bonded to a central flat area on lens element 58. Array 49 is a non-imaging optic detector array mounted as a central obscuration on lens element 58.

Detection processing and tracking is intimately tied to optical seeker output performance. The tracking is established when a target, in particular an illuminating tag, appears as a pixel in a portion of the optical array. Position is determined and steering commands generated in order to null the error in both the cross track and along track axis.

Control Processor System

The control processor subsystem 46 performs three primary functions in the improved, replaceable fuze assembly: detection processing of the optical seeker output to validate the correct one of a plurality of authentication codes from the illuminator and provide validated seeker outputs for navigation; secondly, establish roll control of the mortar round based on included inertial sensors (gyros), preferably negating any roll of the munition; and thirdly, provide steering commands to the flight control subsystem canards 27 based on roll control and optical seeker outputs. In addition to inputs from the optical seeker, the control processor subsystem 46 receives inputs from the Ram Air Turbine (RAT) 34 of the fuze. Typically, other fuze components can be incorporated for time of flight and apogee determination, a g-switch launch detector for accurate launch determination, and the body mounted thumbwheel switch for authentication code selection. Apogee detect can also be supplied through external data other than the RAT of the fuze thereby eliminating any specific hardware dependencies.

Seeker Detection Processing—A number of different approaches can be utilized for efficient application of signal processing to further optimize the receiver performance. To minimize cost, signal processing is combined with the requirement for temporal discrimination for multiple homing illuminators. The approach selected is a two pulse coincidence gate where the coincidence time was selective for 1 of 16 different windows (FIG. 8). The physical selection is with a rotary switch located on the external periphery of the fuze shell.

Simulations of signal acquisition with a signal to noise ratio (SNR) consistent with a 0.1/sec false alarm rate and adequate detection probability (>6 dB) have demonstrated that a signal can be reliably acquired within 64 msec. This is more than adequate to meet the guidance requirements for all shots. When operating with legacy laser target designators, coincidence gating is bypassed since no unique codes are required for this operation. If desired, processing could be modified to include current MIL-STD EOCCM codes.

Roll Control—Zero roll is maintained by using a Proportional-Integral-Derivative (PID) control loop indicated generally at 75, (FIG. 9). The "proportional" and "integral" inputs come from the pitch and yaw rate gyros, indicated at 63A and 63B, respectively. The "derivative" input comes from the roll rate gyro 63C (FIG. 7). These three inputs are combined to estimate the instantaneous roll rate component and steer the canards appropriately to offset this roll effect as shown in FIG. 10, that is, deroll munition 1.

Steering Control—Steering control has two separate components: YAW (left/right) control, in which the canards, acting in pairs, provide horizontal displacement, and Elevation (up/down) in which the canards, again operating in pairs, provide an increment or decrement to the projectile range. Two of the diagonally opposed canards also provide the roll control discussed above. FIG. 10 demonstrates this effect.

Input to the flight or steering control subsystem comes from the seeker detection processor, which provides information regarding the mostly likely pixel array element at rates between 10 Hz (laser designators) and 1 KHz (seeker illuminator). The steering control processor estimates the bore sight offset location at >10 Hz rate. This allows the steering control processor to provide a finer estimate than the seeker processor provides.

Left/Right Steering Correction—The horizontal steering correction term is determined from the left/right centering error determined from the detector array 49. This error is used to determine the necessary correction to drive the canards to correct any lateral aiming error by use of a L/R steering loop 77 (FIG. 5). The flight control subsystem also monitors the bore sight angle and accounts for any angle of attack (AOA) developed because of the steering command and repositions the canards accordingly. An outline of this process is shown in FIG. 10. In the actual flight control processor, the canard positions will be continually updating, therefore the angle of attack will be constantly adjusted. Thus, the instantaneous illumination of the homing illuminator will slowly oscillate back and forth across the centerline of the detector array.

Up/Down Steering Correction—Vertical steering correction is done in a similar manner to the horizontal steering correction. However, unlike the left/right correction where the desired horizontal angle of attack is known and equals zero (at the detector array centerline), the up/down correction requires a vertical angle of attack which is dependent on the mortar trajectory and time to impact. By using the RAT developed time-to-apogee, an estimate of the mortar trajectory and remaining time of flight can be determined. This is achieved by a trajectory estimator circuit 79 (FIG. 5). A table in the processor subsystem will store the allowable mortar trajectories and will fit the best match to the true trajectory. Using this desired trajectory the desired vertical angle of attack can be determined at each 10 Hz update point. The true vertical angle of attack can then be compared to this desired angle of attack and the necessary correction can be made. The up/down steering correction is made by a U/D steering loop 78 and is combined appropriately with the roll correction to deflect the canards as appropriate.

As shown in FIG. 10, a two axis configuration with 3 degrees of freedom (DOF) is preferred which will provide (1) roll stabilization by a differential canard deflection, (2) left/right steering, and (3) up/down steering. In this 3-DOF controller approach, a vertical reference is estimated and the projectile is rolled to a fixed roll angle. With a fixed roll angle, it is then possible to command up/down and/or left/right turns to adjust the trajectory.

Figure 4:
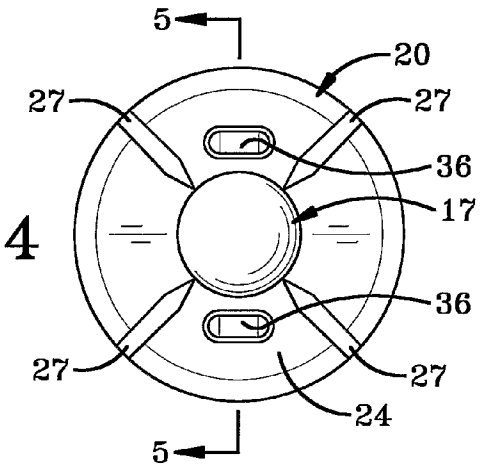
FIG. 4 is a front elevational view of the optically guided munition of FIGS. 2 and 3.

The trajectory correction approach involves estimation of the trajectory and a determination of the impact point relative to the target. If the mortar is on course, the target will be centered with respect to the left/right center line represented by the body axis graph 70 (FIG. 4). It will also be aimed at the proper elevation angle vs. time. Thus, the downward look angle will follow a specific time history. For a cross track error the location of the target with respect to the left/right of the bore sight center line is the "horizontal" error signal. This error is used to deflect the canards to correct the cross track error. In this case a trajectory estimate is not needed, and only an estimate of down is required to roll the mortar to zero degree roll angle.

To correct along-track errors, the "vertical" error signal is computed from the difference between the nominal bore sight look down angle and the bore sight look down angle measured by the seeker. To implement this approach, the trajectory is estimated by trajectory estimator circuit 79 (using time to apogee and launch speed). This trajectory estimate is then used to provide the nominal look down angle to the impact point. This nominal angle is time dependent and decreases a few degrees per second. This nominal value is compared to the seeker value. If the nominal value exceeds the seeker value then the current trajectory will pass over the target. In this case a downward correction is applied. If the nominal value is less than the measured value, an upward correction is applied.

In the absence of gravity, the nominal bore sight look down angle would be zero. In this case the mortar has a "direct fly in" approach. The effect of gravity diminishes as the mortar closes on the target for short range shots using high quadrant elevation (>45 degrees) because the approach angle is closer to vertical. Thus the ballistic correction approach morphs into a direct fly in approach.

When a maneuver command is applied, the mortar develops an angle of attack (AOA). This AOA shifts the look angle to the target. As an example, for a 0.2 g maneuver a 6-DOF model shows that the AOA will be about 1.9 degrees. Thus, if the projectile is initially aimed 1 degree to the right of the target in the horizontal direction and a 0.2 g left maneuver is commanded, the target look angle will be 0.9 degrees to the right. As the mortar velocity vector turns left towards the target, the look angle will move further to the right. This does not indicate an over shoot. In fact the turn must be continued until the look angle is 1.9 degrees to the right. At this point the canards are zeroed and the AOA trims back to zero. With zero AOA and the velocity vector pointing to the target, the look angle will be zero. It is important to account for this AOA effect when steering because the expected AOA will be of comparable magnitude to the aim angle error.

The detection and target tracking functionality are integrated within the overall guidance and control system shown in FIGS. 6-10. It is anticipated that the functionality of the guidance and control system 44 can be implemented on double sided rigid-flex printed circuit boards similar to those already implemented for existing M734A1 fuzes. The individual circuit boards are compatible with the inner diameter of the fuze with components mounted normal to the direction of launch acceleration to further improve tolerance to launch shock loads as shown in FIG. 3. This approach has been demonstrated successfully in environments of over 25 kg's in large caliber munitions such as the 105 and 155 mm guided howitzer shells.

Gyros 63, preferably utilize MEMS technology and sense body rate, (yaw, pitch, and roll). These gyros are mounted in an orthogonal array in the mid-body section of the fuze. These gyros as commercially available, such as from Analog Devices, Inc., and have been demonstrated to over 2 kg's acceleration loads and are able to sustain launch at the 4.5 kg's level without modification. Other components can be obtained from demonstrated high G shock technologies in order to meet the required setback levels. Thus no new component technology is required to develop, host, integrate, test, and field the detection processing and target tracking algorithm of the present invention, thereby reducing the cost of the smart fuze.

Those skilled in the art will appreciate that the method, apparatus and system of the present invention provides highly efficient means compatible with existing processor technology. Furthermore, the method, system and apparatus of the present invention also supports a variety of seeker output designs and interfaces and are compatible with multiple coded input signals. Furthermore, the system and method of the present invention utilizes many commercially available components in a unique way for performing the roll stabilization and flight control to the target resulting in an externally low cost system.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An optically guided ballistic shell comprising:

a casing adapted to contain an explosive charge;

a guidance and control system located in a fore portion of the casing, said guidance and control system including:

an optical seeker for detecting an optical illuminator located at a target;

a processor for generating steering commands based upon sight information received by the optical seeker; and a canard assembly for changing the flight path of the shell from its ballistic flight path based upon the steering commands received from the processor.

2. The optically guided ballistic shell defined in claim 1 including a fuze mechanism for detonating the shell at the target; and a safe/arm mechanism to prevent the fuze mechanism from detonating an errant shell.

3. The optically guided ballistic shell defined in claim 2 including an air turbine for controlling the safe/arm mechanism.

4. The optically guided ballistic shell defined in claim 1 including a self contained power source for powering the processor and canard assembly.

5. The optically guided ballistic shell defined in claim 1 wherein the processor includes a plurality of gyros to sense gravity induced overturning moment to provide data for roll angle estimation and down determination.

6. The optically guided ballistic shell defined in claim 1 wherein the processor includes a Proportional-Integral-Derivative control loop having at least three rate sensor gyros to sense the pitch, rate and yaw of the shell.

7. The optically guided ballistic shell defined in claim 1 wherein the processor includes an algorithm to determine roll and target error and provide the steering commands to the canard assembly.

8. The optically guided ballistic shell defined in claim 1 wherein the canard assembly includes four canards, two of which are each independently controlled and two others being dependently controlled to provide a three-axis control assembly.

9. The optically guided ballistic shell defined in claim 1 wherein the processor includes a seeker detection algorithm which generates the steering commands for the canard assembly based upon signals received from a roll control loop and a controller which compares nominal bore sight angle to a measured bore sight angle.

10. The optically guided ballistic shell defined in claim 1 wherein a validation code is contained in the processor for comparison to a code contained in signals received from the optical illuminator.

11. The optically guided ballistic shell defined in claim 10 including a manually actuated device for setting the validation code in the processor.

12. The optically guided ballistic shell defined in claim 1 wherein the optical seeker includes seeker optics for detecting the optical illuminator at the target and a detector array for generating target error which is supplied to the processor.

13. The optically guided ballistic shell defined in claim 12 wherein the optical seeker uses a non-uniform pixel array and looks off bore sight for determining target error which is supplied to the processor.

14. The optically guided ballistic shell defined in claim 13 wherein the processor makes range corrections to the ballistic descent path of the shell by comparing nominal bore sight angle to the measured bore sight angle as a function of time.

15. A replacement fuze assembly for mounting on a forward end of a shell body for an optically guided ballistic shell, said fuze assembly including:

an optical seeker for detecting an optical illuminator located at a target;

a guidance and control processor for generating steering commands based upon sight information received by the optical seeker;

a canard assembly for changing the flight path of the ballistic shell from its ballistic flight path based upon the steering commands received from the guidance and control processor; and a fuze mechanism for detonating the ballistic shell at the target.

16. The fuze assembly defined in claim 15 wherein the optical seeker includes seeker optics for detecting the optical illuminator at the target and a detector array for generating target error which is supplied to the processor.

17. The fuze assembly defined in claim 16 wherein the optical seeker incorporates non-imaging optics and a course pixel sensor.

18. The fuze assembly defined in claim 15 including a safe/arm assembly, a ram air turbine for actuating the safe/arm assembly, a booster pellet and a battery.

19. The fuze assembly defined in claim 15 wherein the canard assembly includes four canards, two of which are each independently controlled and two others being dependently controlled to provide a three-axis control assembly.

20. The fuze assembly defined in claim 15 wherein the guidance and control processor includes a processor subsystem which has a seeker detection algorithm which generates the steering commands for the canard assembly.

* * * * *